US006895606B2

(12) United States Patent
Walsh

(10) Patent No.: US 6,895,606 B2
(45) Date of Patent: May 24, 2005

(54) PISTON TYPE DRAIN CLEARING APPARATUS

(76) Inventor: Patrick James Walsh, 117 Hickory Hill Dr., Stephens City, VA (US) 22855

( * ) Notice: Subject to any disclaimer, the term of this patent is extended or adjusted under 35 U.S.C. 154(b) by 0 days.

(21) Appl. No.: 10/465,739

(22) Filed: Jun. 19, 2003

(65) Prior Publication Data

US 2004/0010842 A1 Jan. 22, 2004

Related U.S. Application Data

(60) Provisional application No. 60/416,711, filed on Oct. 7, 2002, provisional application No. 60/406,027, filed on Aug. 26, 2002, provisional application No. 60/406,023, filed on Aug. 26, 2002, provisional application No. 60/403,068, filed on Aug. 13, 2002, provisional application No. 60/397,871, filed on Jul. 22, 2002, and provisional application No. 60/396,515, filed on Jul. 16, 2002.

(51) Int. Cl.[7] ..... E03D 9/00
(52) U.S. Cl. ..... 4/255.02
(58) Field of Search ..... 4/255.01–255.12; 134/166 C, 167 C, 168 C, 169 C

(56) References Cited

U.S. PATENT DOCUMENTS

| | | | | | |
|---|---|---|---|---|---|
| 382,129 | A | | 5/1888 | Austin | |
| 1,047,726 | A | | 12/1912 | Yoggerst | |
| 2,001,230 | A | * | 5/1935 | Wayne | 4/255.04 |
| 2,844,826 | A | | 7/1958 | Cheiten | |
| 3,021,532 | A | | 2/1962 | Grass | |
| 3,934,280 | A | | 1/1976 | Tancredi | |
| 4,186,451 | A | | 2/1980 | Ruo | |
| 4,733,414 | A | * | 3/1988 | Wilkes | 4/255.03 |
| 5,199,114 | A | | 4/1993 | Christopher | |
| 5,522,094 | A | | 6/1996 | Balazs | |
| 6,001,086 | A | * | 12/1999 | Rammacher | 604/327 |
| 6,192,525 | B1 | | 2/2001 | Tash | |
| 6,374,427 | B1 | | 4/2002 | Tash | |

* cited by examiner

*Primary Examiner*—Charles E. Phillips
(74) *Attorney, Agent, or Firm*—William Eshelman

(57) ABSTRACT

An apparatus for clearing a clog in a pipe having a diameter, the apparatus including a hollow, rigid cylindrical body, the body having a closed end, an open end and an inside diameter that is less than the diameter of the pipe at the clog thereby providing a mechanical advantage in removing the clog; a piston disposed in the body for reciprocation therein; a rod attached to the piston and extending through an opening in the closed end of the body; a handle located on an upper portion of the rod; and a seal attached to the open end of the body.

7 Claims, 6 Drawing Sheets

PISTON TYPE DRAIN CLEARING APPARATUS

CROSS-REFERENCE TO RELATED APPLICATIONS

This application claims the benefit of priority of the following six U.S. provisional patent applications: Ser. Nos. 60/396,515 filed on Jul. 16, 2002; 60/397,871 filed on Jul. 22, 2002; 60/403,068 filed on Aug. 13, 2002; 60/406,023 filed on Aug. 26, 2002; 60/406,027 filed on Aug. 26, 2002; and 60/416,711 filed on Oct. 7, 2002. The above-referenced six provisional patent applications are hereby expressly incorporated by reference.

BACKGROUND OF THE INVENTION

The invention relates in general to drain clearing devices and in particular to piston type drain clearing devices.

The common toilet plunger is well known for its use in clearing toilet drain outlets and comprises a wooden handle that terminates in a resilient, flexible rubber cup. The user depresses on the handle, deforming the rubber cup and thus creating pressure pulses that are transmitted to the obstruction. This may be repeatedly tried in the effort to unseat the obstruction.

Several problems are often encountered when attempting to use the common toilet plunger. In particular, sufficient force is often not delivered to the obstruction because of the inability to maintain an adequate seal. Even if an adequate seal of the plunger cup over the outlet is achieved, substantial physical effort may be required to successfully clear the obstruction. In addition, splashing of the toilet bowl contents can happen if the seal is not maintained while plunging.

A snake device, commonly consisting of long coiled wire, may be used. But the snake device can require even more physical effort on the part of the user, is difficult to employ, and is messy. For clogs in waste lines, a strong chemical agent is often used in an attempt to clear the clog. The disadvantages of this method are that the chemical agent is very caustic and must be handled with great care as well as the fact that the agent must be repeatedly purchased as it is consumed.

SUMMARY OF THE INVENTION

It is an object of the invention to provide a piston type drain cleaning apparatus for cleaning clogs from, for example, toilets, sinks and lavatories.

It is another object of the invention to provide a piston type drain cleaning apparatus that utilizes a mechanical advantage to increase the force applied to a clog in a pipe.

It is a further object of the invention to provide a seal between the drain cleaning apparatus and the clogged drain pipe that minimizes splashing and maximizes the sealing effect.

It is yet another object of the invention to provide an inexpensive, easy to use, and lightweight clean-out tool that can be comfortably used by persons who lack sufficient physical strength to successfully use the common and well-known toilet plunger.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
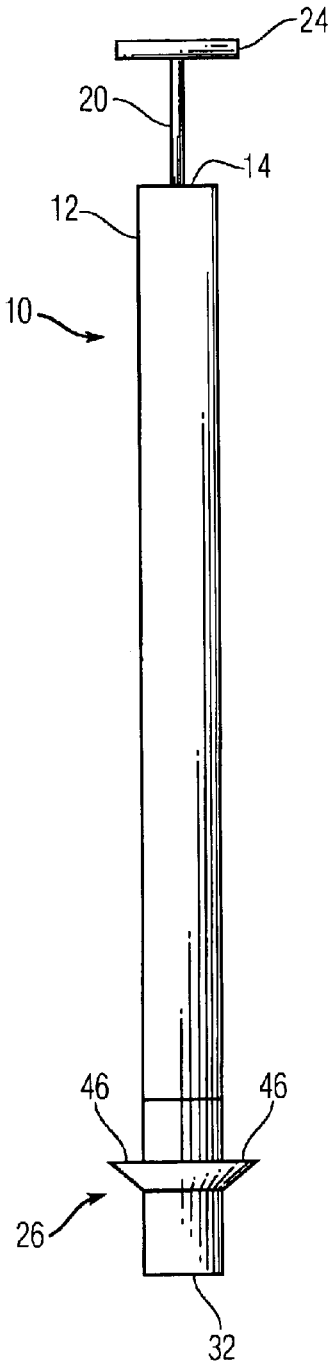
FIG. 1 is a side view of one embodiment of the present invention.
Figure 2:
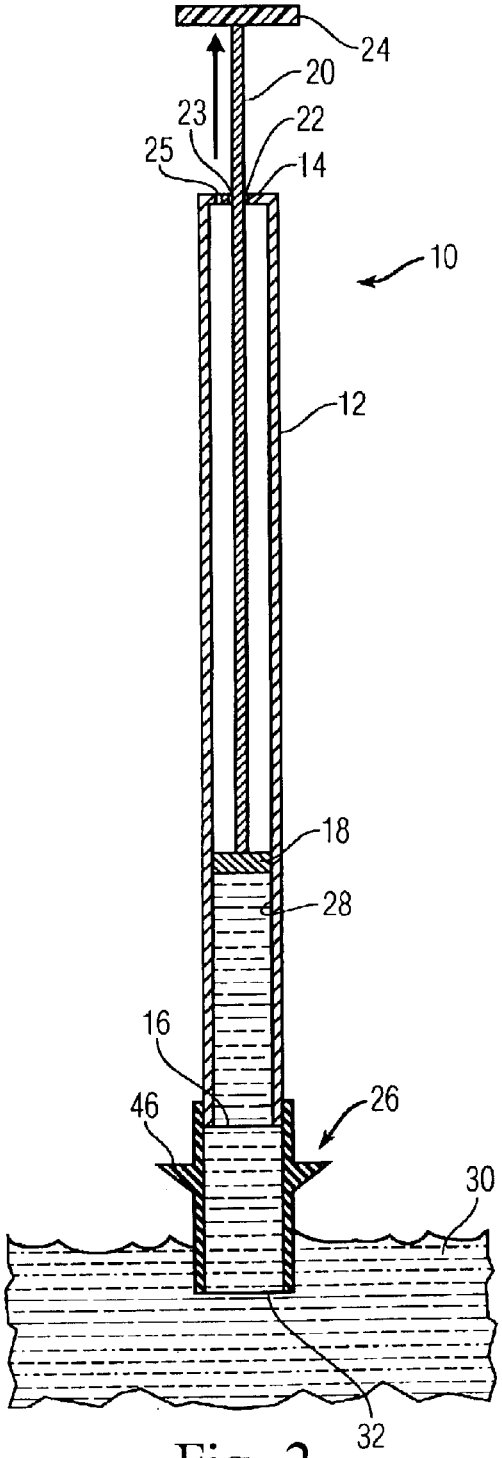
FIG. 2 is a partial cross-sectional view of the embodiment of FIG. 1 showing water being drawn up into its hollow tube and end section.

FIG. 1 is a side view of one embodiment of a drain clearing apparatus 10 according to the invention. FIG. 2 is a partial cross-sectional view of the embodiment of FIG. 1 showing water being drawn up into its hollow tube and end section. Apparatus 10 includes a hollow, rigid cylindrical body 12. Body 12 has a closed end 14 and an open end 16. A piston 18 is disposed in the body 12 for reciprocation therein. A rod 20 is attached to the piston 18 and extends through an opening 22 in the closed end 14 of the body 12. A handle 24 is located on an upper portion of the rod 20. A seal 26 is attached to the open end 16 of the body 12. Seal 26 is slipped over the lower end of body 12 and attached thereto by, for example, using adhesive to bond seal 26 to the lower end of body 12.

The handle 24 and the rod 20 may be made of, for example, plastic, metal, or another rigid material, preferably waterproof. The body 12 may be made of, for example, plastic, metal, or another sturdy waterproof material. The seal 26 may be made of, for example, rubber, plastic or some other waterproof material. The piston 18 may be made of, for example, rubber, plastic, or a similar material or some combination thereof.

Referring now to FIG. 2, the piston 18 forms a movable seal with the inside surface 28 of the body 12. The seal 26 is shown partially submerged in a liquid source 30, for example, a standing pool of water contained in a toilet bowl. The water 30 is drawn up into seal 26 and the body 12 as handle 24 is pulled upward in the direction of the arrow in FIG. 2. Handle 24 is pulled up to its full extent or nearly so in preparation for use (some water may need to be added to the toilet bowl before this step). The opening 32 at the bottom of seal 26 must remain below the surface of the water 30 at all times during this step. The seal 26 and the body 12 below the piston 18 will now be mostly full of water 30. Some air, which is not shown in FIG. 2, may also be present inside the seal 26 and the body 12.

Alternatively, air from the atmosphere can be used as the fluid medium rather than water simply by pulling up the handle 24 to its full extent or nearly so, as indicated by the direction of the arrow in FIG. 2, before the apparatus 10 is inserted into the liquid 30. When the portion of the body 12 below the piston 18 is mostly full of water 30 or air from the atmosphere—depending upon which fluid medium is chosen, it is ready to be positioned for use. If water 30 is used as the fluid medium, the opening 32 of the seal 26 must remain below the surface of the water 30 after the filling of the body 12 with water 30 and while the apparatus 10 is positioned for use.

As shown in FIG. 2, the opening 22 in the closed end 14 of the body 12 may include a passageway 23 for air to enter and exit that portion of the body 12 between the piston 18 and the closed end 14 of the body 12. In addition or alternatively, the closed end 14 of the body 12 may include a second opening 25 for air to enter and exit the portion of the body 12 between the piston 18 and the closed end 14 of the body 12.

Figure 3:
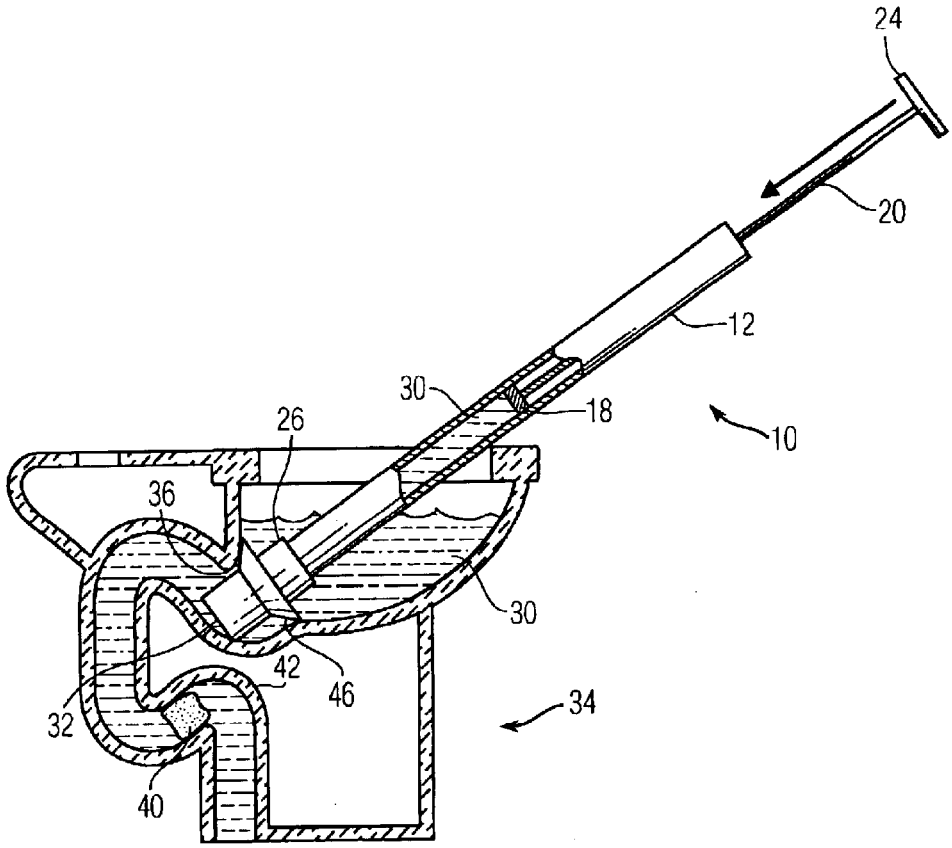
FIG. 3 is a side view of the embodiment of FIG. 1 engaged with a toilet outlet opening and with the toilet shown in cross-section.

FIG. 3 is a side view of the embodiment of FIG. 1 engaged with a toilet outlet opening 36 and with the toilet 34 shown in cross-section. Referring now to FIG. 3, which shows the apparatus 10 positioned for use, a cross-section of a toilet 34 is shown with the apparatus 10 engaged with the toilet drain outlet. Seal 26 is slid into toilet drain outlet 36 until flange 46 forms an effective seal with toilet drain opening 36. The user grips body 12 with one hand and maintains downward force to ensure an effective seal while the other hand is simultaneously used to push the handle 24 down as indicated by the arrow. This action causes the air or the water 30 (which is shown in FIG. 3), depending upon which fluid medium is chosen, to be forcefully expelled out of opening 32 into toilet drain outlet 36. The force of the water 30 dislodges the clog 40 in pipe 42.

In a preferred embodiment, the inside diameter of the body 12 is less than the inside diameter of the pipe 42 at the clog 40 thereby providing a distinct mechanical advantage in removing the clog 40. To gain this mechanical advantage, the inside diameter of the body 12 is preferably less than 2.125 inches and more preferably less than 1.875 inches. The body 12, rod 20, and seal 26 may be constructed in different sizes to accommodate a longer or shorter drain clearing apparatus. Further, the size of the opening 32 in seal 26 may be varied to accommodate different diameter drain openings such as sink drains, bathtub drains, floor drains and the like. However, to retain the important mechanical advantage, the inside diameter of the portion of the body 12 wherein the piston 18 reciprocates must be less than the inside diameter of the pipe 42 at the clog 40.

Figure 4A:
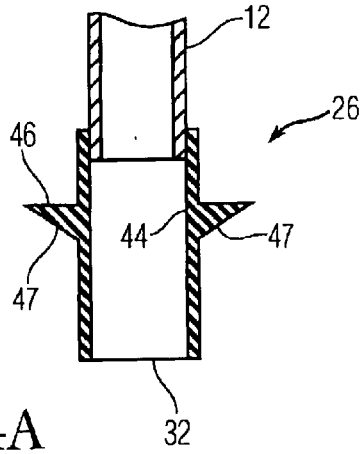
FIGS. 4A, 4B and 4C are cross-sectional side views of seals.
Figure 4B:
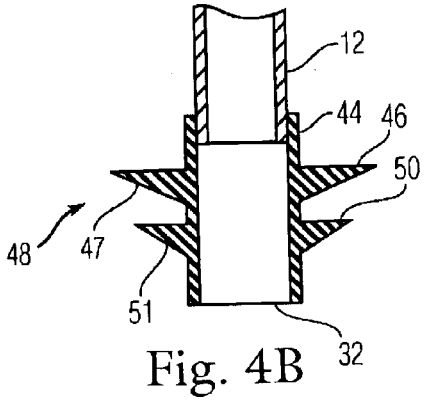
Figure 4C:
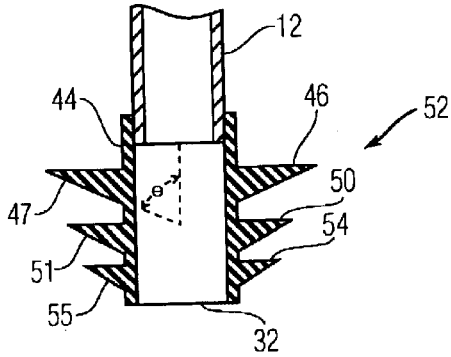

FIG. 4A is a cross-section of seal 26. Seal 26 comprises a hollow cylinder 44, which may be rigid or flexible. The external surface of the cylinder 44 includes at least one flexible flange 46 disposed thereon. FIG. 4B is a cross-section of a seal 48 having a hollow cylinder 44 and two flexible flanges 46, 50. FIG. 4C is a cross-section of a seal 52 having a hollow cylinder 44 and three flexible flanges, 46, 50, 54. Seals with more than three flexible flanges are also within the scope of the invention.

As shown in FIGS. 4B and 4C, when more than one flange is used, the diameters of the flanges preferably decrease in a direction away from the body 12 of the apparatus. For example, in FIG. 4B, the diameter of flange 50 is less than the diameter of flange 46. Similarly, in FIG. 4C, the diameter of flange 54 is less than the diameter of flange 50 which is less than the diameter of flange 46. Each flange 46, 50, 54 includes an underside 47, 51, 55 that preferably angles up and away from the hollow cylinder 44 of the seals. The angle theta of the undersides 47, 51, 55 of flanges 46, 50, 54 with the longitudinal centerline of each seal is preferably in the range of about 30 degrees to about 60 degrees.

Figure 5A:
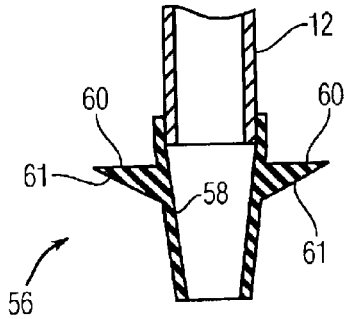
FIGS. 5A, 5B and 5C are cross-sectional side views of seals.
Figure 5B:
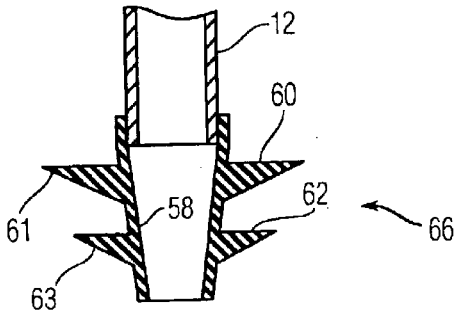
Figure 5C:
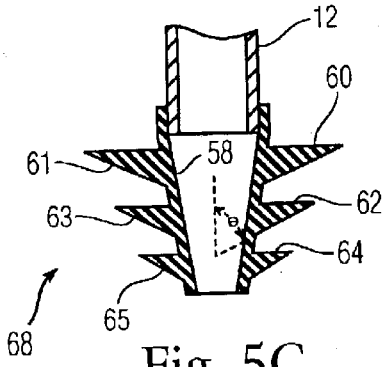

FIG. 5A is a cross-section of a seal 56 attached to body 12. Seal 56 comprises a hollow truncated cone 58, which may be rigid or flexible. Cone 58 has an external surface with at least one flexible flange 60 disposed thereon. The larger diameter end of the cone 58 is attached to the open end of the body 12 by, for example, fasteners such as screws, grommets or clamps and/or an adhesive. FIG. 5B is a cross section of a seal 66 having a hollow truncated cone 58 and two flexible flanges 60, 62. FIG. 5C is a cross-section of a seal 68 having a hollow truncated cone 58 and three flexible flanges, 60, 62, 64. Seals with more than three flexible flanges are also within the scope of the invention.

As shown in FIGS. 5B and 5C, when more than one flange is used, the diameters of the flanges preferably decrease in a direction away from the body 12 of the apparatus. For example, in FIG. 5B, the diameter of flange 62 is less than the diameter of flange 60. Similarly, in FIG. 4C, the diameter of flange 64 is less than the diameter of flange 62 which is less than the diameter of flange 60. Each flange 60, 62, 64 includes an underside 61, 63, 65 that preferably angles up and away from the hollow truncated cone 58 of the seals. The angle theta of the undersides 61, 63, 65 of flanges 60, 62, 64 with the longitudinal centerline of each seal is preferably in the range of about 30 degrees to about 60 degrees.

Figure 9:
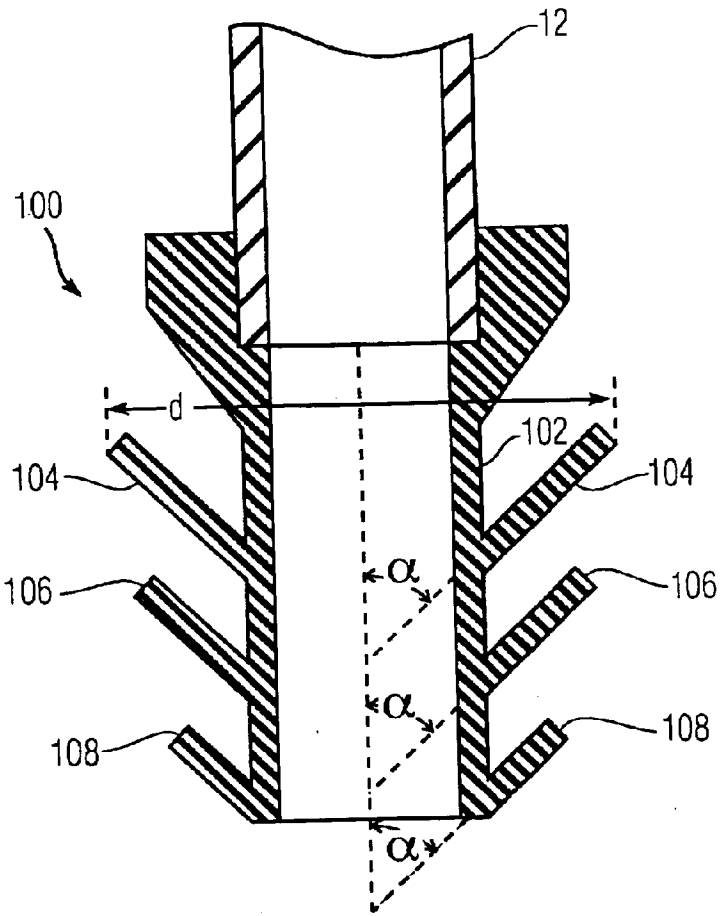
FIG. 9 is a cross-sectional side view of a seal.

FIG. 9 is a cross-section of a seal 100 attached to body 12. Seal 100 comprises a hollow cylinder 102, which may be rigid or flexible. The external surface of the cylinder 102 includes at least one flexible flange 104 disposed thereon. Seal 100 may have additional flexible flanges 106 and 108 disposed thereon. Seal 100 may also have more than three flexible flanges. When more than one flange is used, the diameters d of the flanges preferably decrease in a direction away from the body 12 of the apparatus. For example, in FIG. 9, the diameter of flange 108 is less than the diameter of flange 106 and the diameter of flange 106 is less than the diameter of flange 104. Each flange 104, 106, 108 preferably angles up and away from the hollow cylinder 102. The angle alpha of each flange with the longitudinal centerline of the seal is preferably in the range of about 30 degrees to about 60 degrees. By way of example and not limitation, the diameter of flange 104 may be about 3.26 inches, the diameter of flange 106 may be about 2.96 inches and the diameter of flange 108 may be about 2.7 inches. The thickness of each flange may be, for example, about 0.16 inches.

Figure 10:
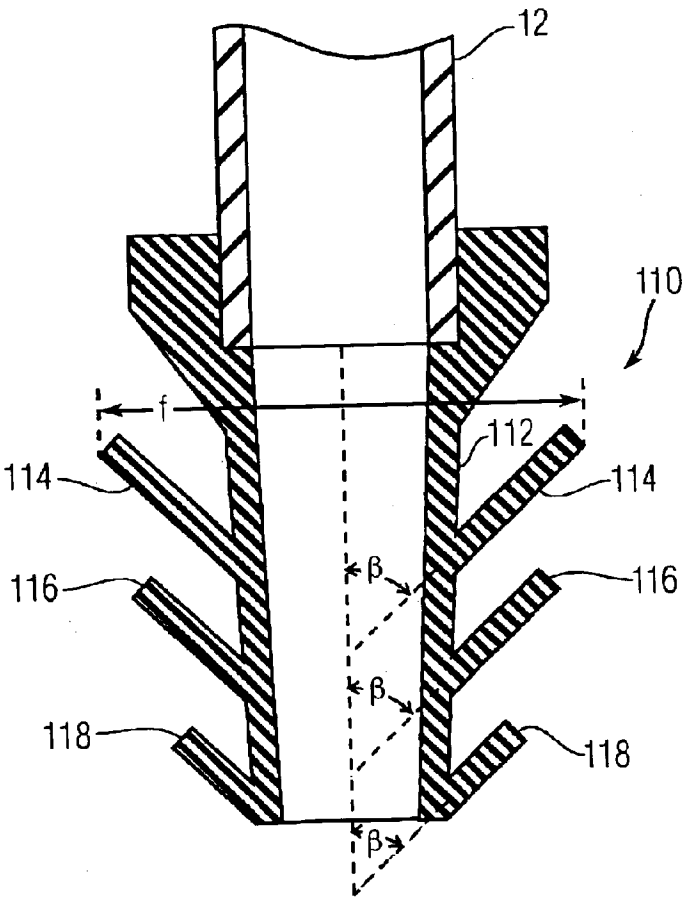
FIG. 10 is a cross-sectional side view of a seal.

FIG. 10 is a cross-section of a seal 10 attached to body 12. Seal 110 comprises a hollow truncated cone 112, which may be rigid or flexible. The external surface of the truncated cone 112 includes at least one flexible flange 114 disposed thereon. Seal 110 may have additional flexible flanges 116 and 118 disposed thereon. Seal 110 may also have more than three flexible flanges. When more than one flange is used, the diameters f of the flanges preferably decrease in a direction away from the body 12 of the apparatus. For example, in FIG. 10, the diameter of flange 118 is less than the diameter of flange 116 and the diameter of flange 116 is less than the diameter of flange 114. Each flange 114, 116, 118 preferably angles up and away from the truncated cone 112. The angle beta of each flange with the longitudinal centerline of the seal is preferably in the range of about 30 degrees to about 60 degrees. By way of example and not limitation, the diameter of flange 114 may be about 3.26 inches, the diameter of flange 116 may be about 2.96 inches and the diameter of flange 118 may be about 2.7 inches.

Referring now to the flanged seals shown in FIGS. 4A–C, 5A–C, 9 and 10, as the flanges are inserted into the drain outlet, the flanges are compressed inward. Because of the angle of the flanges, the flanges grip the inner walls of the drain outlet to form a biased seal. The biased seal requires more force to remove the flanges than was required to insert the flanges into the drain opening. Thus, this novel sealing mechanism is able to resist significant backpressure during use and allows the user to use much less downward force on the device to maintain an effective seal.

Figure 6A:
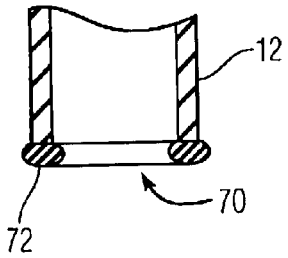
FIGS. 6A and 6B are cross-sectional views of seals and FIG. 6C is a bottom view of the seals of FIGS. 6A and 6B.

FIG. 6A is a cross-sectional view of a seal 70 attached to body 12 by, for example, adhesive bonding. Seal 70 is substantially donut or ring shaped. Seal 70 comprises, for example, a solid-elastomeric material 72. Seal 70 provides a large contact area between the seal 70 and the surface around a drain opening. The large contact area provides more stability to the apparatus 10 during use and thus increases the likelihood of maintaining an effective seal.

Figure 6B:
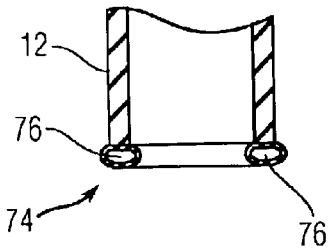
Figure 6C:
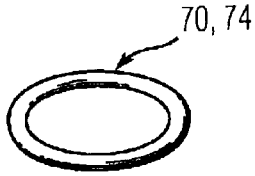

FIG. 6B is a cross-sectional view of a seal 74 attached to body 12. Seal 74 is substantially donut or ring shaped, hollow and comprises an elastomeric material filled with a fluid 76. The fluid-filled seal 74 may contain air, water or any other fluid under low pressure which allows the seal 74 to conform to surface imperfections surrounding waste-line drains and to the user's nonuniform application of force during use. The seal 74 exerts uniform pressure over its contact area due to the fluid 76 being of homogeneous pressure, thereby providing an effective seal for the device over a waste-line opening. FIG. 6C is a bottom view of the seals 70, 74 of FIGS. 6A and 6B showing the donut or ring shape. Seals 70 and 74 are preferably used for waste lines such as sinks and lavatories, but may also be used with toilets.

Figure 7:
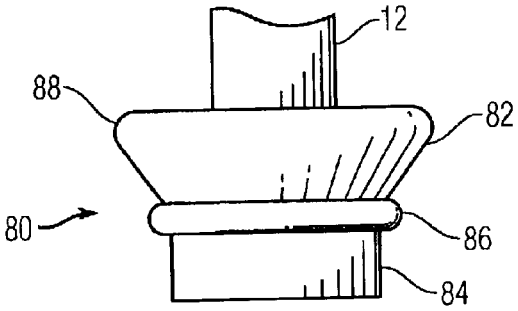
FIG. 7 is a side view of a seal.

FIG. 7 is a side view of a seal 80. Seal 80 comprises comprises a hollow, truncated conical portion 82, a hollow cylindrical portion 84 joined to the conical portion 82 and a substantially donut shaped portion 86 disposed at a junction of the conical and cylindrical portions. The larger diameter end 88 of the conical portion 82 is attached to the open end 16 of the body 12. In one preferred embodiment, the substantially donut shaped portion 86 comprises a compressible, solid elastomeric material. In another preferred embodiment, the substantially donut shaped portion 86 is hollow and comprises an elastomeric material filled with a fluid, such as air.

Figure 8A:
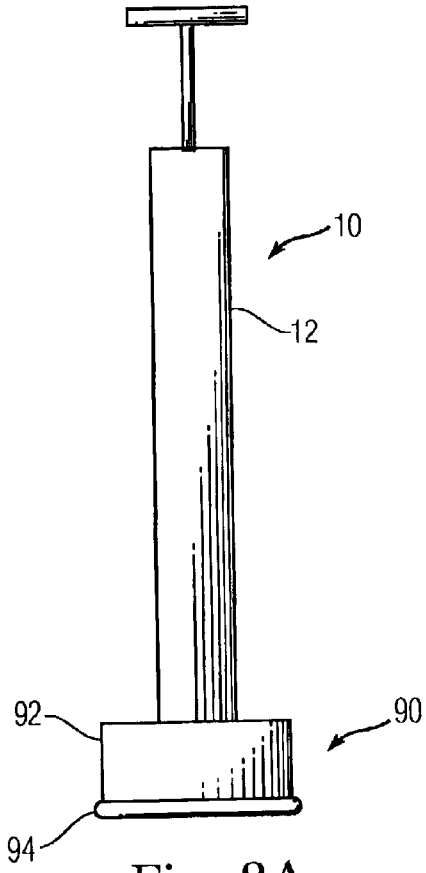
FIG. 8A is a side view of a seal and FIG. 8B is a sectional view of the seal of FIG. 8A.
Figure 8B:
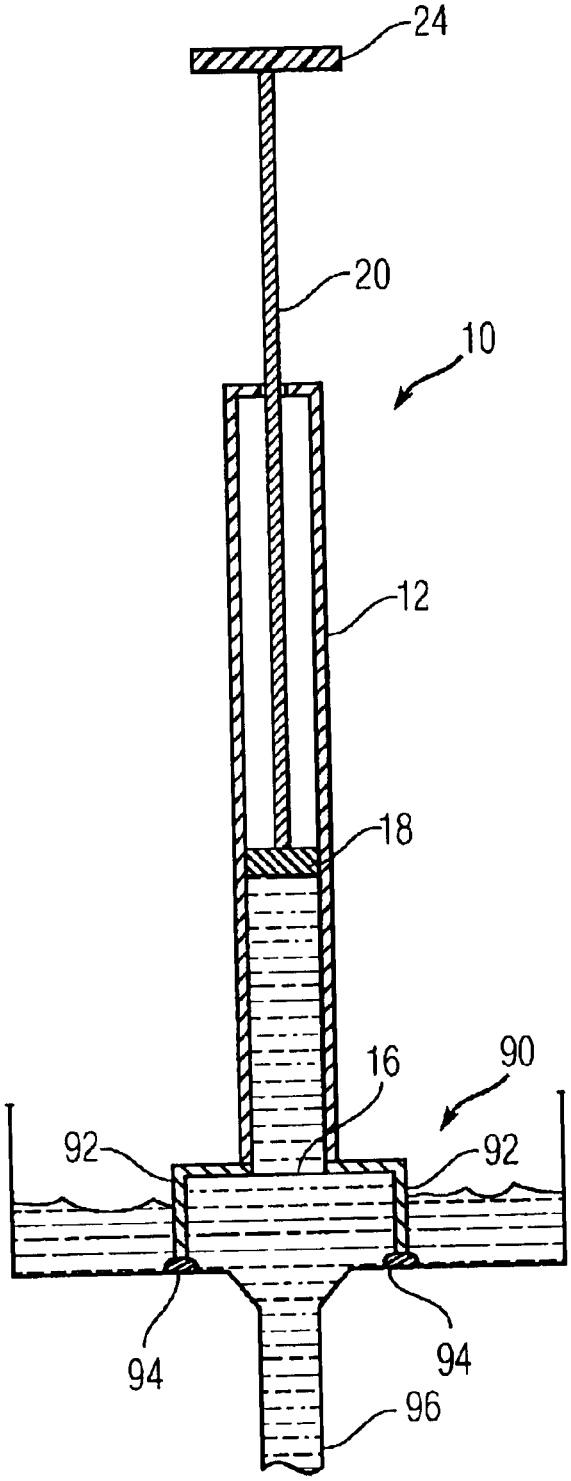

FIG. 8A is a side view of a seal 90 and FIG. 8B is a sectional view of the seal 90 of FIG. 8A. Seal 90 comprises a hollow, cylindrical portion 92 attached to the open end 16 of the body 12 and a substantially donut shaped portion 94 attached to a bottom of the cylindrical portion 92. The hollow, cylindrical portion 92 is substantially rigid and has an inside diameter greater than the inside diameter of the body 12. Because of the increased diameter portion 92, seal 90 is preferable for waste lines with larger openings. FIG. 8B shows seal 90 placed over a waste line 96 exiting from, for example, a sink or lavatory. In one embodiment, the substantially donut shaped portion 94 comprises a compressible, solid elastomeric material. In another embodiment, the substantially donut shaped portion 94 is hollow and comprises an elastomeric material filled with a fluid, such as air.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for clearing a clog in a pipe having an inside diameter, the apparatus comprising:

a hollow, rigid cylindrical body, the body having a closed end, an open end and an inside diameter that is less than the inside diameter of the pipe at the clog thereby providing a mechanical advantage in removing the clog;

a piston disposed in the body for reciprocation therein;

a rod attached to the piston and extending through an opening in the closed end of the body;

a handle located on an upper portion of the rod; and a seal attached to the open end of the body, the seal comprising a hollow cylinder having an external surface, the external surface including a plurality of flexible flanges disposed thereon wherein diameters of the flexible flanges decrease in a direction away from the body.

2. The apparatus of claim 1 wherein undersides of the flexible flanges are angled up and away from the hollow cylinder of the seal.

3. The apparatus of claim 1 wherein the flexible flanges are angled up and away from the hollow cylinder of the seal.

4. An apparatus for clearing a clog in a pipe, the apparatus comprising:

a hollow, rigid cylindrical body, the body having a closed end and an open end;

a piston disposed in the body for reciprocation therein;

a rod attached to the piston and extending through an opening in the closed end of the body;

a handle located on an upper portion of the rod; end a seal attached to the open end of the body, the seal comprising a hollow cylinder having an external surface, the external surface including a plurality of flexible flanges disposed thereon wherein diameters of the flexible flanges decrease in a direction away from the body.

5. The apparatus of claim 4 wherein undersides of the flexible flanges are angled up and away from the hollow cylinder of the seal.

6. The apparatus of claim 5 wherein a number of flanges is three.

7. The apparatus of claim 4 wherein the flexible flanges are angled up and away from the hollow cylinder of the seal.

* * * * *